US006074166A

United States Patent [19]

Moddemeijer

[11] Patent Number: 6,074,166

[45] Date of Patent: Jun. 13, 2000

[54] PUMP

[76] Inventor: Pieter J. H. Moddemeijer, 4124 S. Jackson St., Amarillo, Tex. 79110

[21] Appl. No.: 09/164,937

[22] Filed: Oct. 1, 1998

[51] Int. Cl.[7] ..... F04D 29/08

[52] U.S. Cl. ..... 415/109; 415/171.001; 415/198.001; 415/199.004; 415/200; 415/206; 415/208.2; 415/211.002; 415/214.001; 415/217.001; 416/223 B; 417/423.011

[58] Field of Search ..... 415/109, 171.1, 415/168.1, 168.2, 169.1, 200, 206, 208.2, 211.2, 214.1, 217.1, 199.4, 198.1; 416/223 B; 417/373, 423.11

[56] References Cited

U.S. PATENT DOCUMENTS

| | | | |
|---|---|---|---|
| Re. 34,319 | 7/1993 | Boutin et al. . | |
| 3,513,942 | 5/1970 | Sato | 415/168.2 |
| 4,242,039 | 12/1980 | Villard et al. . | |
| 4,526,507 | 7/1985 | Bingler . | |
| 4,884,945 | 12/1989 | Boutin et al. | 415/174.2 |
| 4,915,579 | 4/1990 | Whittier et al. | 415/171.1 |
| 5,261,786 | 11/1993 | Sidelko | 415/171.1 |
| 5,344,163 | 9/1994 | Roll et al. . | |
| 5,489,187 | 2/1996 | Ray . | |
| 5,609,468 | 3/1997 | Burgess . | |

*Primary Examiner*—Edward K. Look
*Assistant Examiner*—Ninh Nguyen
*Attorney, Agent, or Firm*—Arthur F Zobal

[57] ABSTRACT

The pump is formed by pump housing defining a pump housing cavity and a column housing defining an elongated cavity. The front of the column housing is coupled to the rear of the pump housing cavity. A shaft axially from the rear of the column housing cavity into the pump housing cavity. An impeller is connected to the front of the shaft for rotation in the pump housing cavity for moving liquid from the front inlet through an outlet transverse to the axis. The impeller has vanes on its front and rear sides. A baffle is fixedly secured to the front of the column housing around the shaft and has vanes on its rear side for preventing liquid rearward of the baffle in the column housing cavity from rotating.

16 Claims, 9 Drawing Sheets

PUMP

BACKGROUND OF THE INVENTION

1. Field of the Invention

The invention relates to a pump for use for pumping acid or other caustic liquids.

2. Description of the Prior Art

In certain industries, such as the computer chip manufacturing industry, acid is used in the process which requires pumps for pumping the acid. Special pumps are required in order to operate in and withstand the corrosive nature of the acid environment. Many of these types of pumps are made from plastic which can withstand the acid. However, metal parts and seals for the pumps cannot be effectively used for over long periods of time.

SUMMARY OF THE INVENTION

It is an object of the invention to provide a pump which can effectively operate in an acid or other type of caustic liquid environment.

The pump comprises a housing having a front end with an inlet leading to a pump housing cavity. A shaft extends from a rear end into the cavity for rotation about a central axis. An outlet extends from the cavity through the housing wall transverse to the axis. An impeller is coupled to the shaft in the cavity for rotation with the shaft. The impeller has vanes on its front and rear sides. A baffle is fixedly secured in the cavity around the shaft spaced rearward of the impeller and has vanes on its rear side.

In the embodiment disclosed, the housing is formed of a pump housing defining the pump housing cavity and a column housing defining an elongated cavity. The front of the column housing is coupled to the rear of the pump housing. At least one radially extending tab is coupled to the exterior of the column housing to be located between two spaced apart tabs extending rearward from the pump housing to prevent the two housing members from rotating relative to each other. Many of the pump components are formed of plastic and a motor is coupled to the rear of the shaft for rotating the shaft. A propeller is coupled to the rear of the shaft inside the elongated cavity for preventing fumes from reaching the motor.

DESCRIPTION OF THE PREFERRED EMBODIMENTS

Figure 1:
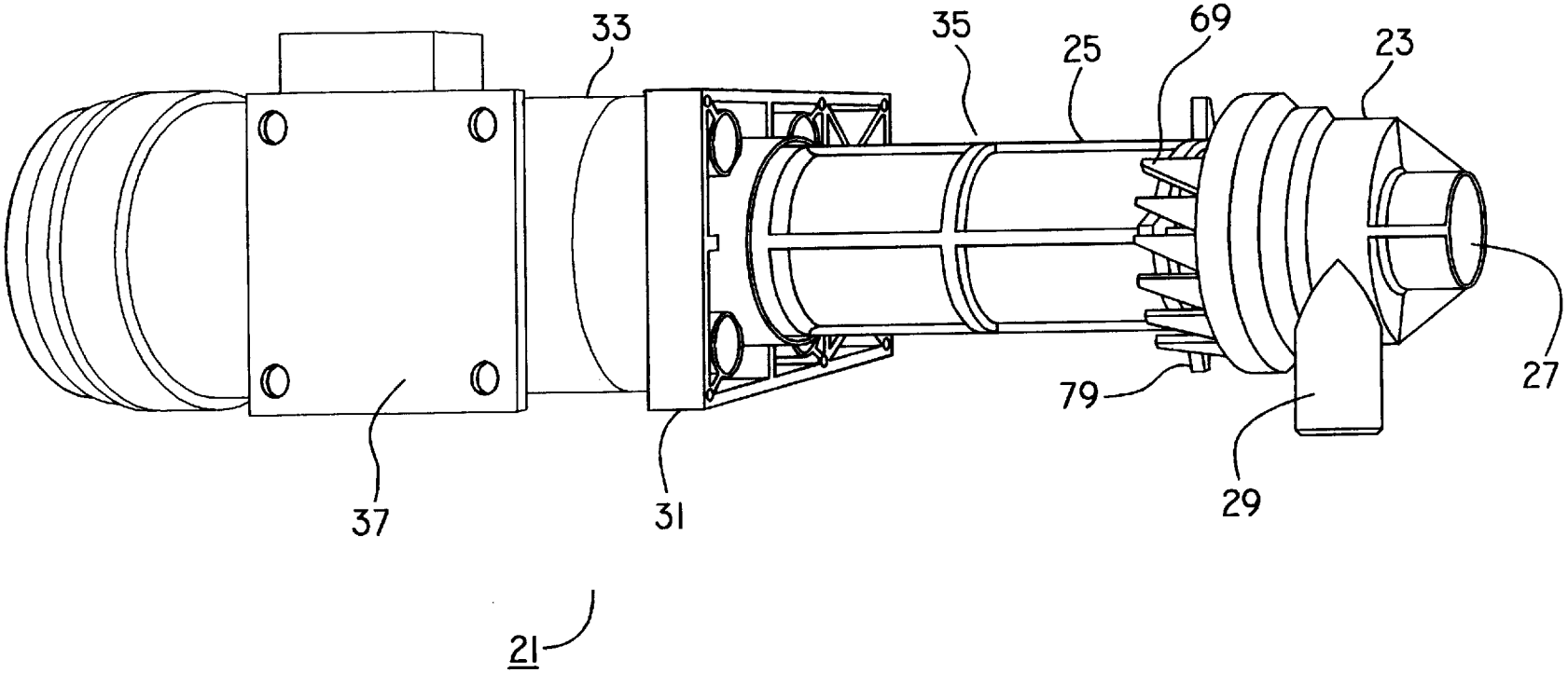
FIG. 1 illustrates the exterior of the pump housing of the pump of the invention.

Referring now to FIG. 1 of the drawings, the pump of the invention is identified by reference numeral 21. It comprises a housing formed by a pump housing 23 and a column housing 25 coupled together. The pump housing has a suction inlet 27 and a side outlet tube or nozzle 29. The rear of the column housing 25 is coupled to one side of a base plate 31 which in turn is coupled to an electric motor 33 for operating the pump. In use, the pump will be supported in a vertical position in a container of liquid such as acid with the suction inlet 27 located in a downward position. The pump will be located in the liquid to a depth such that the top level of the liquid extends to a height on the pump at about the position identified by reference numeral 35. The motor housing has a member 37 to be attached to a support mechanism for holding the pump in this position. A conduit will be attached to the outlet tube 29 for directing the flow of liquid to the desired position or mechanism.

Figure 2:
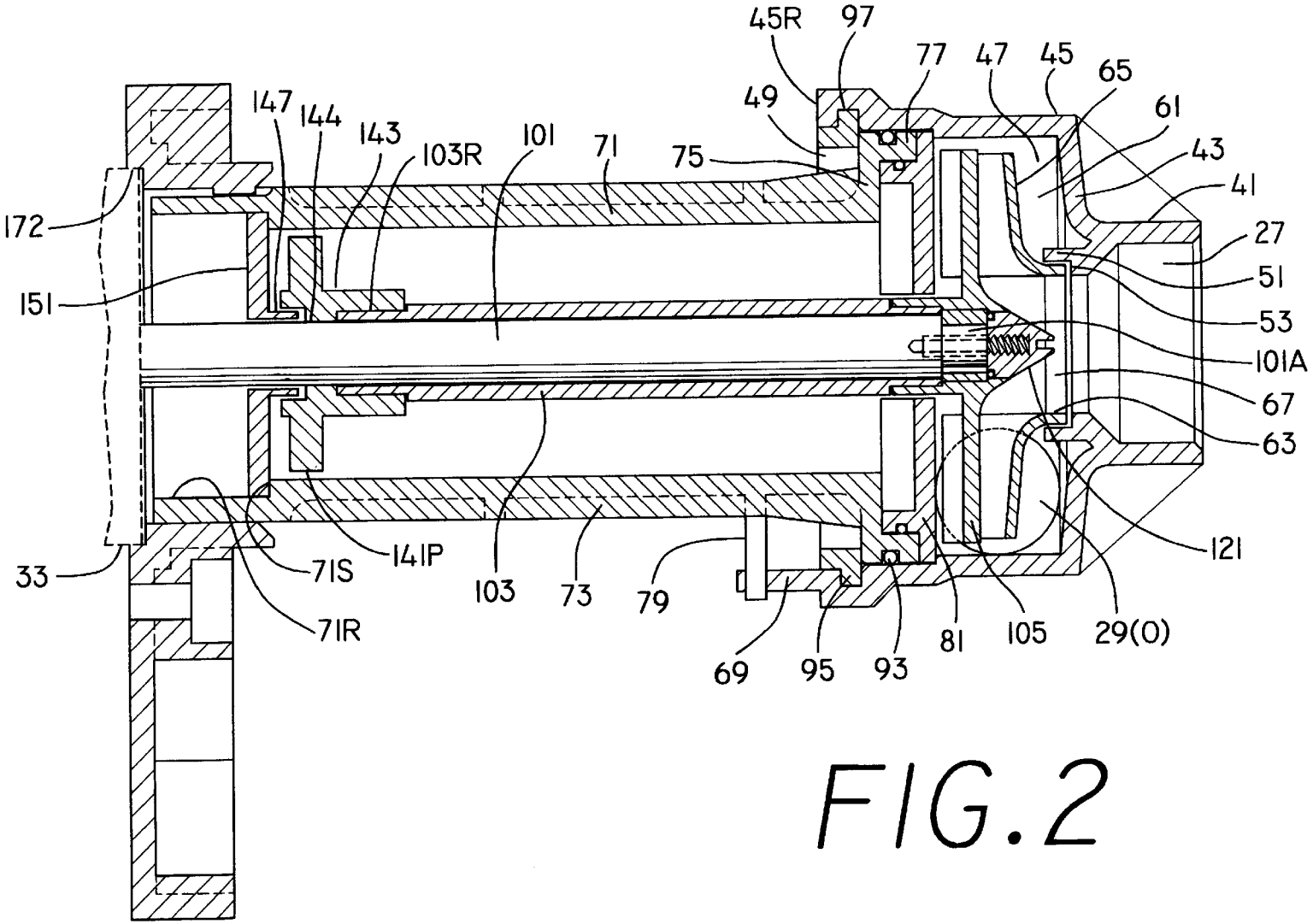
FIG. 2 is a cross-sectional view of the pump.

Referring now to FIG. 2 and the other drawings, the pump housing 23 is formed of plastic and comprises a small diameter annular wall 41 forming the cylindrical inlet 27 which flares outward at 43 to a larger diameter annular wall 45 defining a large cavity 47 with a rear circular open end 49. The inlet 27 leads to the cavity 47 by way of a rearward extending annular wall 51 having an annular shoulder 53. A front cover 61 formed of plastic, has a smaller diameter annular wall 63 which flares outward to a larger diameter plate-like portion 65. The cover 61 has a circular opening 67. The cover 61 is attached to the vanes of the impeller 105 by a suitable glue such that the impeller and the cover 61 rotate together. The opening of the outlet tube 29 is shown at 29(O).

Figure 9:
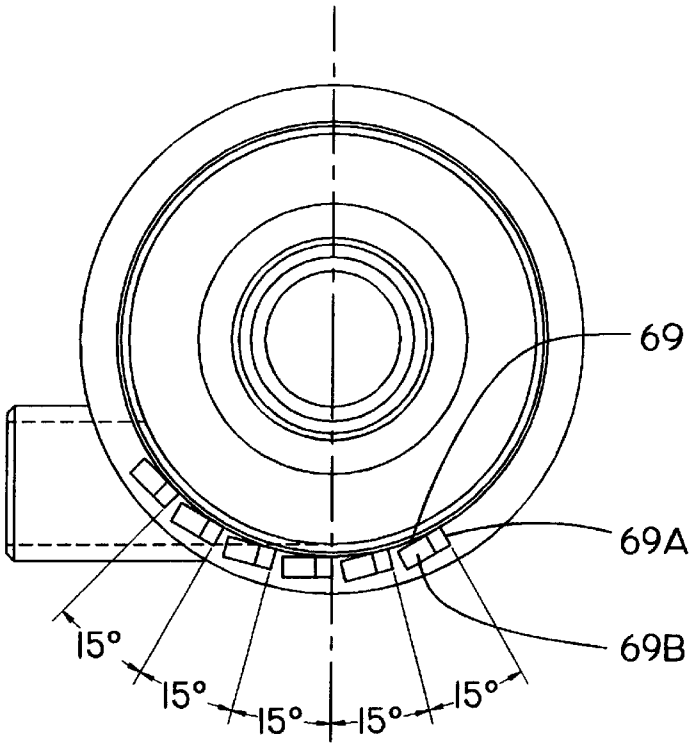
FIG. 9 is a rear view of the front pump housing.

Extending rearward from the rear edge 45R of the housing 23 are six spaced apart tabs 69 each of which has a straight edge 69A and a slanted edge 69B. See FIG. 9. Adjacent straight sides of the group of tabs 69 are spaced 15 degrees apart as shown in FIG. 9.

Figure 16:
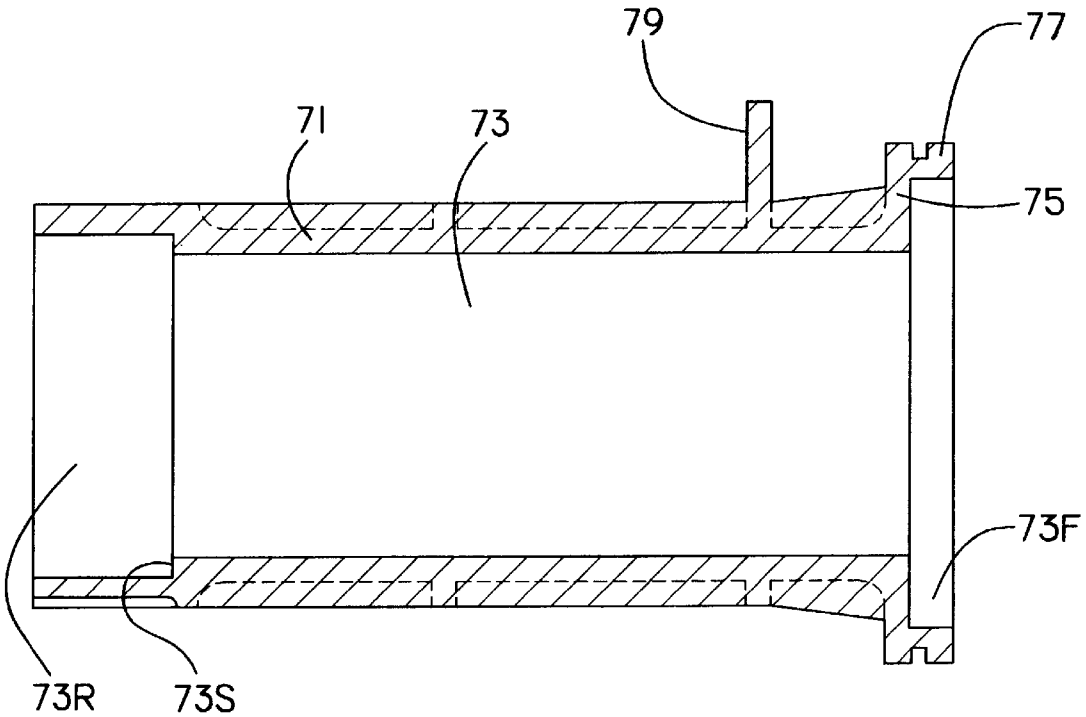
FIG. 16 is a cross-sectional view of the column housing.

The column housing 25 comprise a hollow cylindrical member 71 formed of plastic defining an elongated cylindrical cavity 73. The front of the member 71 extends radially outward at 75 to a forward annular wall 77 forming an enlarged front annular cavity 73F. The rear of the housing 71 has a rear cavity portion 73R with a rear facing shoulder 73S. FIG. 16.

Figure 17:
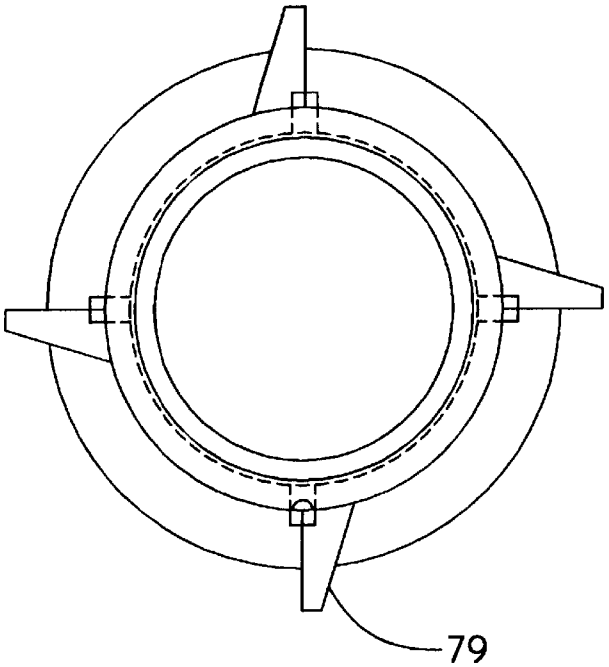
FIG. 17 is an end view of FIG. 16 as seen from its rear end.

Extending radially outward from the exterior of the housing 71 and located near its front end are four spaced apart tabs 79 with each tab having a straight edge and a slanted edge. Adjacent tabs 79 are spaced 90 degrees apart. Note FIG. 17.

Figure 8:
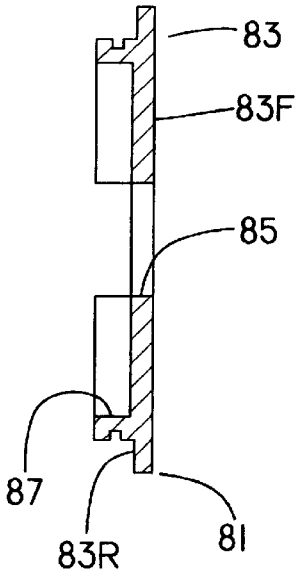
FIG. 8 is a cross-sectional view of FIG. 7 taken along the lines 8—8 thereof.
Figure 7:
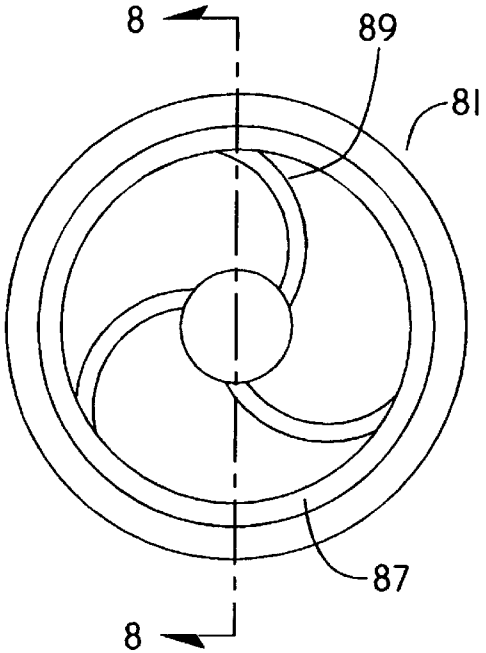
FIG. 7 is a rear view of the baffle of the pump.
Figure 11:
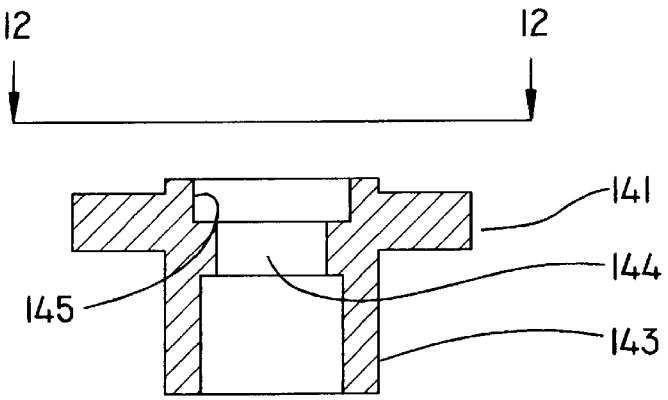
FIG. 11 is a cross-section of FIG. 10 taken along the lines 11—11 thereof.
Figure 12:
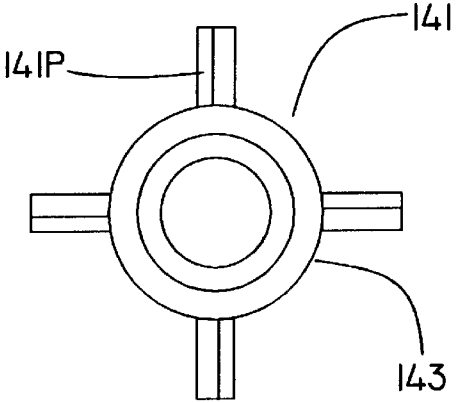
FIG. 12 is an end view of FIG. 11 as seen along lines 12—12 thereof.
Figure 10:
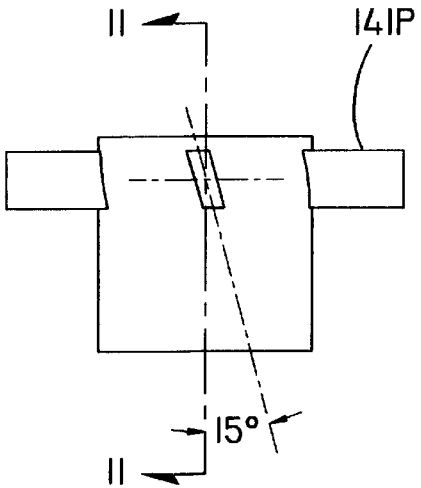
FIG. 10 is a side view of the rear propeller or fan of the pump.

Secured to the front of the housing 71 is a circular baffle member 81 formed of plastic. Referring to FIGS. 7 and 8, the baffle member 81 comprises a ring shaped member 83 having a flat front surface 83F and a central circular opening 85 formed therethrough. Extending from the rear surface 83R is an annular rear wall 87 having a smaller outside diameter than the ring 83 and three angularly spaced apart curved vanes 89.

The vanes 89 extend from the radius of the opening 85 and curve counter-clockwise as seen in FIG. 7 outward to the inside of the annular wall 87. As seen from the suction inlet 27 the vanes 89 curve outward clockwise from the opening 85. The vanes 89 are identical and adjacent vanes start 120 degrees apart from the radius of the opening 85 and curve outward as an arc of a circle.

Figure 3:
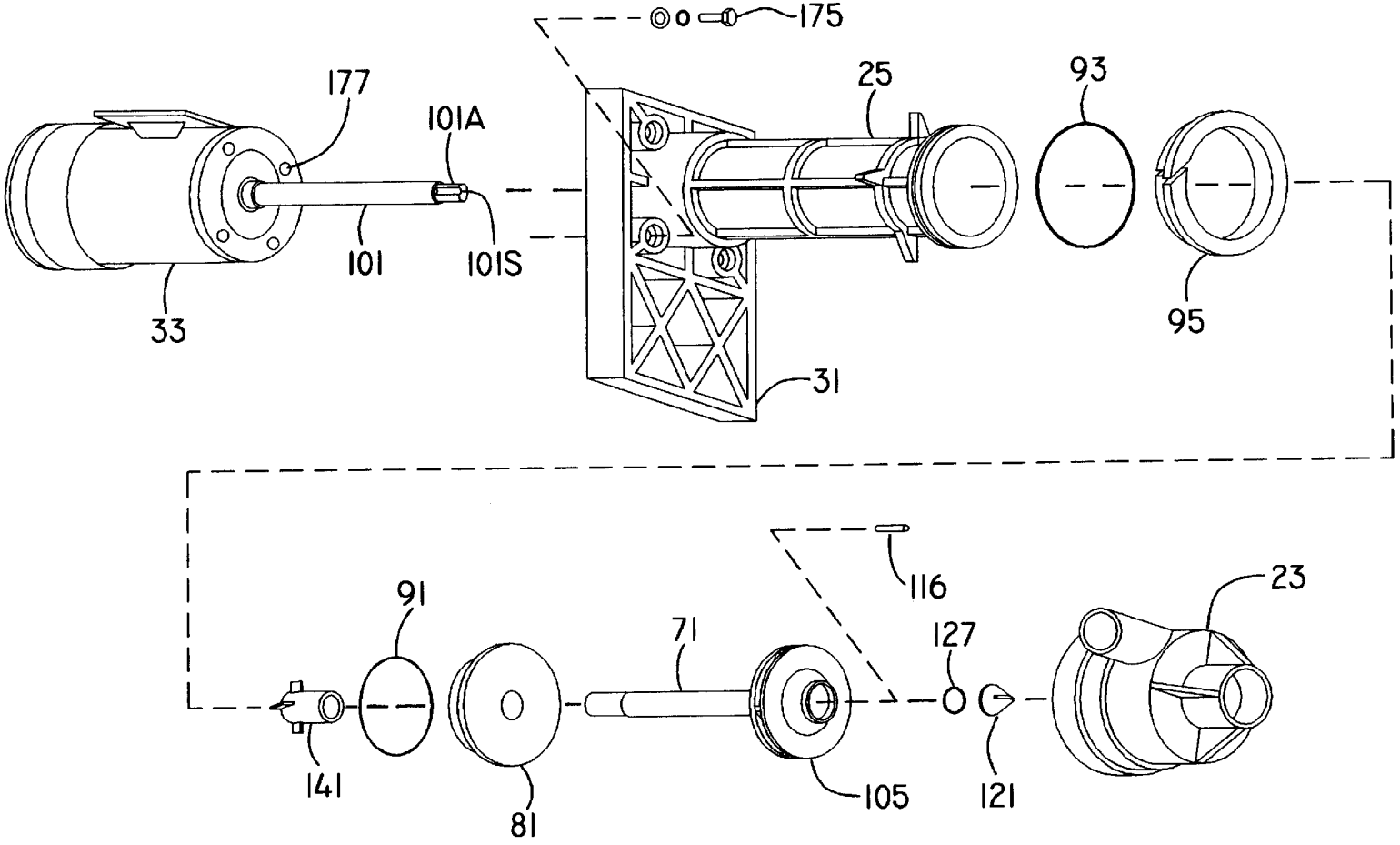
FIG. 3 is an exploded view of the pump including the motor.
Figure 18:
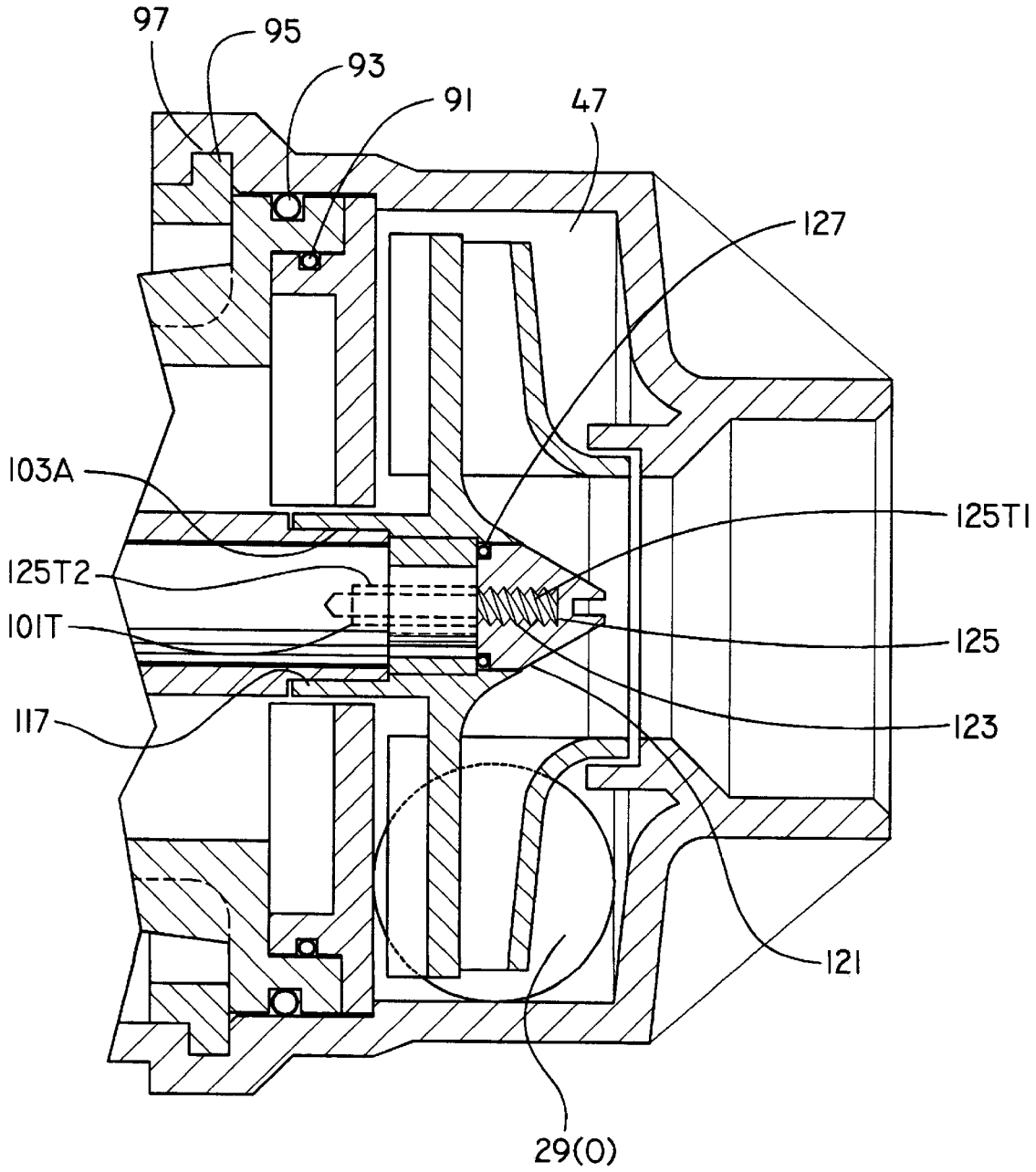
FIG. 18 is an enlarged partial cross-section of the front part of the pump.

Referring to FIG. 3 and 18, members 91 and 93 are elastomer O-ring seals. Member 95 is a plastic snap-ring, L-shaped in cross section located in annular slot 97 for preventing axial movement of the housing members 23 and 25 relative to each other. In operation of the pump, the impeller 105 rotates counter clockwise as seen from the suction inlet 27 looking rearward, such that it discharges liquid in that direction. The reaction force on the pump housing 23 due to this discharge action will be clockwise and will tend to move the pump housing 23 in that direction. In assembling the two housing members together, one of the tabs 79 will be located between two adjacent tabs 69 such that the housing member 23 cannot rotate in a clockwise direction relative to the housing 25 as seen from the suction inlet 27 looking rearward.

Figure 6:
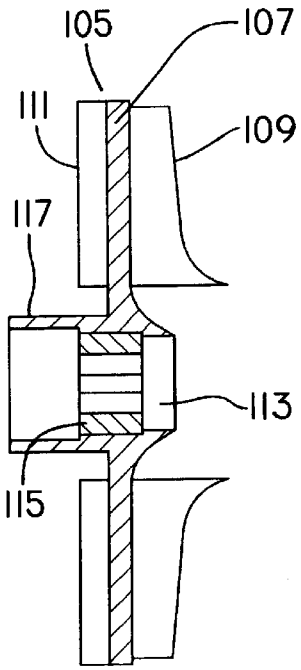
FIG. 6 is a cross-sectional view of the FIG. 5 taken along the lines 6—6 thereof.
Figure 5:
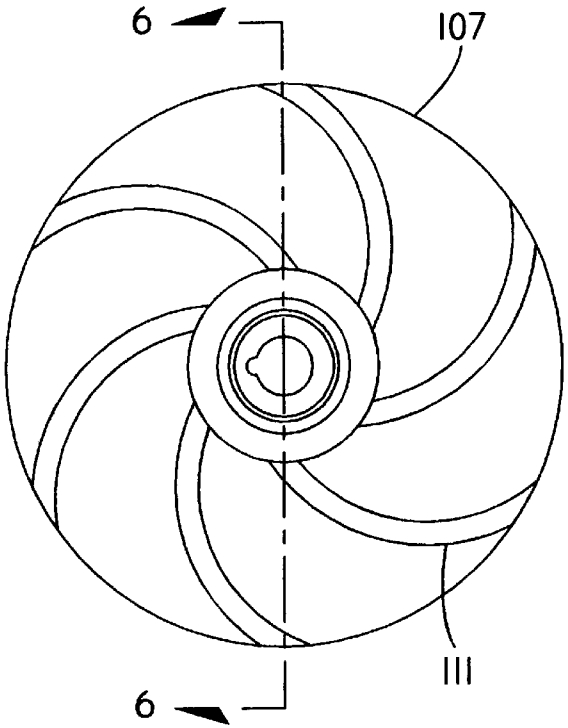
FIG. 5 is a rear view of the impeller of FIG. 4.
Figure 4:
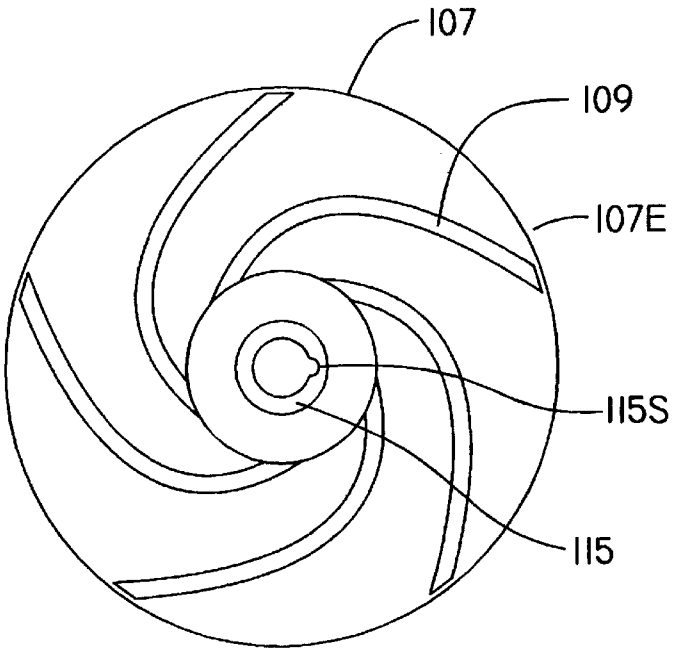
FIG. 4 is a plan view of the front side of the impeller of the pump.

Also provided are a stainless steel shaft 101 connected to the motor 33 (See FIG. 3). In FIG. 2, the shaft 101 is partially shown surrounded by a plastic sleeve 103 and has an impeller 105 formed of plastic attached to its forward end. Referring to FIGS. 4–6, the impeller 105 comprises a round member 107 having vanes 109 found on its front side and vanes 111 formed on the rear side. The central part of the impeller has a central aperture 113 formed therethrough with a stainless steel annular member 115 molded in the rear part of the aperture 113. The inside of the member 115 has a half round slot 115S formed along its length. An annular wall 117 extends from the rear of the impeller 105. The front portion 101A of the shaft 101 has a smaller diameter with a slot 101S formed therein along its outer side. A round key 116 is inserted in the slots 101S and 115S of the shaft 101 and the insert 115 to secure the member 115 and hence the impeller 105 to the front of the shaft 101. A plastic impeller nut 121 is provided which has female threads 123 (See FIG. 18) in which the threads 125T1 of a stainless steel member 125 are screwed. The other end of the member 125 has threads 125T2 which are screwed into female threads 101T of the shaft 101. The nut 121 is screwed into the front opening of the impeller onto threads 125T1 of member 125.

Referring to FIGS. 4 and 6, there are five angularly spaced apart front suction vanes 109 of the impeller 105 which are parabolic in shape and extend outward from a radius outward of the aperture 113. The vanes 109 are identical and curve clockwise outward toward the outer edge 107E of the member 107 but stop short of the outer edge 107E of the member 107. Referring to FIGS. 5 and 6, there are six angularly spaced apart rear repeller vanes 111 on the rear side of the impeller 105 which extend outward from a radius outward of the aperture 113. The vanes 111 are identical and curve counter-clockwise to the outer/edge 107 of the member 107 as seen from the rear side or clockwise as seen from the front side of member 107 or suction inlet 27. Each of the vanes 111 forms an arc of a circle.

Figure 14:
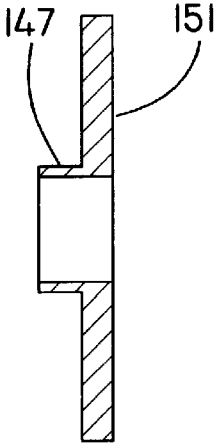
FIG. 14 is a cross-sectional view of FIG. 13 taken along the lines 14—14 thereof.
Figure 13:
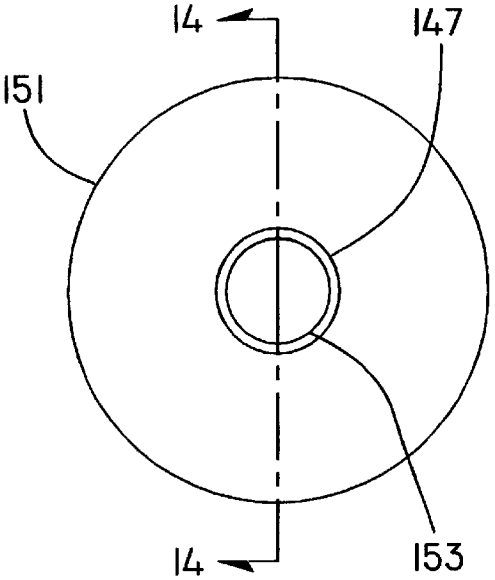
FIG. 13 is an end view of the fume barrier of the pump.

Referring to FIGS. 2, and 10–12, the sleeve 103 of the shaft 101 has a smaller outside diameter rear portion 103R around which is press fitted the sleeve 143 of a plastic member 141 having a smaller inside diameter portion 144 which fits around the shaft 101 and a larger inside diameter portion 145 which freely fits around the sleeve 147 of a plastic fume barrier 151. (See also FIGS. 13 and 14). The fume barrier member 151 has a central circular aperture 153 for freely receiving the shaft 101 of the motor 33. The front outer edge of member 151 is glued to the shoulder 71S and to the inside diameter portion 71R of the housing 71. The member 141 supports four spaced apart propeller blades 141P.

Figure 15:
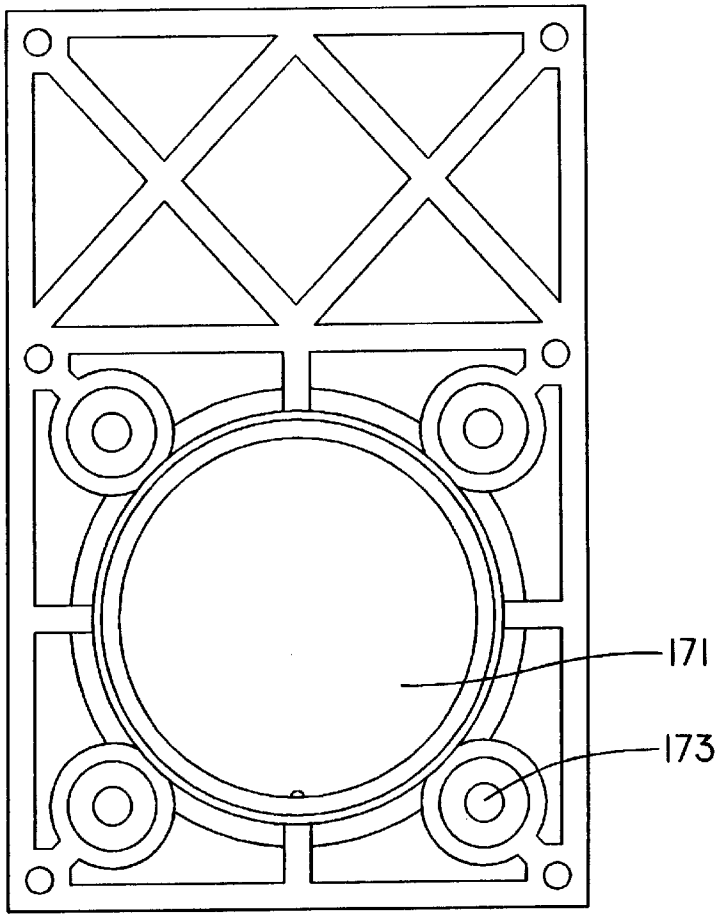
FIG. 15 is a plan view of the base plate of the pump.

Referring to FIGS. 2, 3, and 15 the base plate 31 comprises an opening 172 for receiving the front part of the motor 33 and four-apertures 173 for receiving four bolts 175 for attaching the base plate 31 to the motor by screwing the bolts 175 into four thread holes 177 formed in the front plate of the motor 33.

In assembling the pump, the impeller 105 will be attached to the sleeve 103 by gluing the impeller sleeve 117 around the smaller diameter portion 103A of the sleeve 103. The rear end of the housing 71 will be inserted into the opening 171 of the base plate 31 and glued in place. The base plate 31 then will be attached to the front of the motor 33 with the bolts 175 with the shaft 101 extending into the cavity 73 of the housing 71. The O-ring 93 is installed in the slot in the front portion 77 of the housing 71 and the O-ring 91 is installed in the slot in the baffle 81. With the impeller sleeve 103 vertical, the baffle 81 with the three vanes 89 facing upward is slid around the sleeve 103 until it bottoms out. The propeller sleeve 143 then is pushed and turned on to the end 103R of the sleeve 103 which forms a tight fit. The sleeve 103 with the three vanes of the baffle facing downward is slid over the shaft 101. The wall 87 of the baffle 81 is tapped into the mating cavity formed within the wall portion 73F of the housing 71 to form a tight fit. The keyways 101S and 115S of the shaft 101 and impeller 105 are aligned and the round key 116 is slid into the keyway. The small elastomer O-ring 127 is located in the in slot of the impeller nut 121 and the nut 121 is screwed onto the threads 125T1 of threaded member 125. The snap-ring 95 is opened and slid over the column housing 71 and rested on the four tabs 79. The pump housing 23 is placed with its locking tabs 69 facing downward over the impeller 105.

The discharge nozzle 29(O) is lined up to the desired angle. There are 24 positions available, each 15 degrees apart. The pump housing 23 is pushed toward the column housing 71 until it bottoms out. The pump is placed in a horizontal position and the snap ring 95 is placed into the matching groove 97 of the pump housing 23. The discharge nozzle 29(O) then tapped clockwise, facing the suction, until locking tabs touch.

In operation of the pump, the impeller 105, sleeve 103 and propeller member 141 will all rotate together on the shaft 101 and relative to the housing 23, 25, baffle 81 and the fume barrier 151. There are no seals between the assembly 105, 71, 141 and the baffle 81 since they would be corroded by the acid being pumped. The steel shaft 101 of the motor is protected by the sleeve 103 and impeller 105. The O-rings 91, 93, and 127 are acid or corrosion resistant. Since the pump is located vertically in the liquid to be pumped with its inlet 27 downward, such that the top level of the liquid is at the portion identified by reference numeral 35 in FIG. 1, the liquid will not reach the propeller member 141. As the impeller is rotated, the vanes 109 create a suction, which moves the liquid from inlet 27 through outlet 29(O). The repeller vanes 111 have a slightly greater diameter than that of the impeller vanes 109 and create a higher pressure sideways of the impeller 105 and hence prevents the level of the liquid in the cavity 73 from going higher than the outside liquid level. Without the baffle 81 however, the liquid behind the impeller 105 would rotate which would create a low pressure at the axis which would draw air into the cavity 73 from the rear or motor end. This would cause air bubbles in the acid being pumped which is undesirable. The stationary baffle 81 with its vanes 89 prevent the liquid behind the impeller from rotating and hence prevents the air bubble problem. The propeller 141P will generate an air pressure in a radial and axial direction slightly higher than atmospheric pressure and hence will create a barrier against ascending fumes. In this respect, the propeller 141P directs air away from the motor and rear end of the shaft to keep the fumes away from this zone. The barrier 151 also helps to prevent any fumes from reaching the motor.

The use of the plastic snap ring 95 and the plastic locking tabs 69 and 79 to prevent axial and underside rotational movement between the two housing members 23 and 25, avoids the use of metal bolts or clamps on the pump which cannot be used because of the chemical composition and acidity of the liquid.

It is to be understood that the pump may be employed to pump liquids other than acid such as a liquid base or other liquid chemicals that would normally corrode metal.

All of the plastic parts of the pump may be formed of CPVC, Polypropylene or PVDF. The O-rings may be formed of VITON or EPR. In one embodiment, the outside diameters of the impeller 105 and baffle 81 may be 4.80 inches and 5.160 inches respectively, however, it is to be understood that these dimensions may vary depending on the size of the pump.

What is claimed is:

1. A pump comprising:

a housing formed by first and second members coupled together such that said first and second members extends along a central axis, said first member having a wall defining a front inlet leading to a first cavity in line with said central axis and an outlet extending through said wall of said first member from said first cavity transverse to said central axis, said second member having a wall with front and rear ends defining a second cavity extending between said front and rear ends in line with said central axis, a shaft rotatably supported in said second cavity of said second member and having an axis in line with said central axis with a front end extending into said first cavity, an impeller coupled to said front end of said shaft for rotation with said shaft in said first cavity, said impeller having an axis in line with said central axis, said impeller having a front side facing said inlet with a plurality of vanes angularly spaced apart about its said axis curving outward from an inner portion in a given direction as seen from said inlet of said pump, said impeller having a rear side opposite said front side with a plurality of vanes angularly spaced apart about its said axis curving outward from an inner portion in said given direction as seen from said inlet of said pump, a baffle fixedly secured to said housing rearwardly of said impeller, said baffle having a central aperture through which said shaft extends with said central aperture having a size sufficient to allow said shaft to rotate freely relative to said baffle, said baffle having a front side facing said impeller and a rear side opposite its said front side, said rear side of said baffle having a plurality of vanes angularly spaced apart about said central aperture and curving outward in said given direction as seen from said inlet of said pump, and means for rotating said shaft in a direction opposite said given direction as seen from said inlet of said pump.

2. The pump of claim 1, wherein:

said vanes of said rear side of said impeller and on said baffle curve in a manner to define arcs of a circle, said vanes on said front of said impeller curve in a manner to define parabolas.

3. The pump of claim 1, comprising:

at least one-radial tab extending radially outward from the exterior of said wall of said second member, and at least two spaced apart axial tabs extending rearward from the exterior of said wall of said first member for receiving said radial tab for preventing rotation of said wall of said first member relative to said wall of said second member in a direction opposite the direction of rotation of said impeller.

4. The pump of claim 1, comprising:

a plurality of spaced apart radial tabs extending radially outward from the exterior of said wall of said second member, and a plurality of spaced apart rearward extending tabs extending rearward from the exterior of said wall of said first member such that adjacent rearward extending tabs may receive one of said radial tabs for preventing rotation of said wall of said first member relative to said wall of said second member in a direction opposite the direction of rotation of said impeller.

5. The apparatus of claim 3, wherein:

said first and second members, said impeller, and said baffle are formed of plastic material, and an annular snap ring formed of plastic material for coupling said first and second members together and for preventing axial movement of said first member relative to said second member.

6. The apparatus of claim 4, wherein:

said first and second members, said impeller, and said baffle are formed of plastic material, and an annular snap ring formed of plastic material for coupling said first and second members together and for preventing axial movement of said first member relative to said second member.

7. The pump of claim 1, wherein:

said means for rotating said shaft comprises a motor, said shaft has a rear end coupled to said motor, said second cavity has a rear end defined by said rear end of said wall of said second member and a front end defined by said front end of said wall of said second member, a propeller means coupled to said rear end of said shaft inside said second cavity for applying air pressure toward said front end of said second cavity.

8. The pump of claim 3, wherein:

said means for rotating said shaft comprises a motor, said shaft has a rear end coupled to said motor, said second cavity has a rear end defined by said rear end of said wall of said second member and a front end defined by said front end of said wall of said second member, a propeller means coupled to said rear end of said shaft inside said second cavity for applying air pressure toward said front end of said second cavity.

9. The pump of claim 4, wherein:

said means for rotating said shaft comprises a motor, said shaft has a rear end coupled to said motor, said second cavity has a rear end defined by said rear end of said wall of said second member and a front end defined by said front end of said wall of said second member, a propeller means coupled to said rear end of said shaft inside said second cavity for applying air pressure toward said front end of said second cavity.

10. The pump of claim 5, wherein:

said means for rotating said shaft comprises a motor, said shaft has a rear end coupled to said motor, said second cavity has a rear end defined by said rear end of said wall of said second member and a front end defined by said front end of said wall of said second member, a propeller means coupled to said rear end of said shaft inside said second cavity for applying air pressure toward said front end of said second cavity.

11. The pump of claim 6, wherein:

said means for rotating said shaft comprises a motor, said shaft has a rear end coupled to said motor, said second cavity has a rear end defined by said rear end of said wall of said second member and a front end defined by said front end of said wall of said second member, a propeller means coupled to said rear end of said shaft inside said second cavity for applying air pressure toward said front end of said second cavity.

12. A pump comprising:

a housing having a front end and a rear end defining a cavity, a shaft extending into said cavity from said rear end for rotation about a central axis, an inlet in line with said axis leading to said cavity from said front end, an outlet extending out of said housing transverse to said axis, an impeller coupled to said shaft in said cavity for rotation about said axis for moving liquid from said inlet out of said outlet, said impeller having a front side facing said inlet and a rear opposite side, curved vanes on said front and rear sides of said impeller, and a baffle fixedly secured to said housing and located in said cavity around said shaft spaced rearward of said impeller, said baffle having a central aperture through which said shaft extends with said central aperture having a size sufficient to allow said shaft to rotate freely relative to said baffle.

said baffle having a front side facing said impeller and a rear opposite side, and curved vanes on said rear side of said baffle for minimizing rotation of liquid in said cavity rearward of said baffle.

13. The pump of claim 1, wherein:

a seal is lacking between said shaft and said central aperture whereby liquid can enter said second cavity from said first cavity, a seal is lacking at said rear end whereby air can enter said second cavity from said rear end, said plurality of vanes of said baffle minimize rotation of liquid in said second cavity rearward to said baffle to minimize the reduction of pressure next to said shaft to prevent air from entering said second cavity and mixing with the liquid being pumped.

14. The pump of claim 12, wherein:

a seal is lacking between said shaft and said central aperture whereby liquid can enter said second cavity from said first cavity, a seal is lacking at said rear end whereby air can enter said second cavity from said rear end, said plurality of vanes of said baffle minimize rotation of liquid in said second cavity rearward to said baffle to minimize the reduction of pressure next to said shaft to prevent air from entering said second cavity and mixing with the liquid being pumped.

15. The pump of claim 13, wherein:

said impeller, housing and baffle are formed of plastic.

16. The pump of claim 14, wherein:

said impeller, hosing and baffle are formed of plastic.

* * * * *